US007532084B2

(12) United States Patent
Wada et al.

(10) Patent No.: US 7,532,084 B2
(45) Date of Patent: May 12, 2009

(54) NONRECIPROCAL CIRCUIT ELEMENT

(75) Inventors: Takaya Wada, Kanazawa (JP); Takashi Hasegawa, Omihachiman (JP)

(73) Assignee: Murata Manufacturing Co., Ltd, Kyoto (JP)

( * ) Notice: Subject to any disclaimer, the term of this patent is extended or adjusted under 35 U.S.C. 154(b) by 0 days.

(21) Appl. No.: 11/867,214

(22) Filed: Oct. 4, 2007

(65) Prior Publication Data

US 2009/0058551 A1 Mar. 5, 2009

(30) Foreign Application Priority Data

Aug. 31, 2007 (JP) ..... 2007-226641

(51) Int. Cl.
*H01P 1/36* (2006.01)

(52) U.S. Cl. ..... 333/24.2

(58) Field of Classification Search ..... 333/1.1, 333/24.2

See application file for complete search history.

(56) References Cited

U.S. PATENT DOCUMENTS 6,940,360 B2 9/2005 Takeda et al.
2004/0004521 A1* 1/2004 Hasegawa ..... 333/24.2
2004/0263278 A1 12/2004 Hino

FOREIGN PATENT DOCUMENTS

JP 2003-046307 A 2/2003
WO 2007/046229 A1 4/2007
WO 2007/069768 A1 6/2007

OTHER PUBLICATIONS

Official communication issued in the International Application No. PCT/JP2006/307147, mailed on Jul. 18, 2006.
Official communication issued in counterpart International Application No. PCT/JP2007/071213, mailed on Jan. 29, 2008.

* cited by examiner

*Primary Examiner*—Stephen E Jones
(74) *Attorney, Agent, or Firm*—Keating & Bennett, LLP

(57) ABSTRACT

A non-reciprocal circuit element capable of improving an isolation characteristic without increasing an insertion loss includes a permanent magnet, a ferrite arranged to receive a direct-current magnetic field from the permanent magnet, and first and second center electrodes disposed on the ferrite. One end of the first center electrode is connected to an input port, whereas the other end is connected to an output port. One end of the second center electrode is connected to the output port, whereas the other end is connected to a ground port. A matching capacitor and a resistor are connected between the input port and the output port. An inductor and a capacitor constituting an LC resonant circuit are connected in series with the resistor.

6 Claims, 10 Drawing Sheets

NONRECIPROCAL CIRCUIT ELEMENT

BACKGROUND OF THE INVENTION

1. Field of the Invention

The present invention generally relates to non-reciprocal circuit elements, and, more specifically, to a non-reciprocal circuit element, such as an isolator and a circulator, for use in the microwave band.

2. Description of the Related Art

Generally, non-reciprocal circuit elements, such as isolators and circulators, have a characteristic that permits a signal to be transmitted only in a predetermined direction but not in the opposite direction. By utilizing this characteristic, for example, isolators are used in transmitting circuits of mobile communication devices, such as automobile phones and cellular phones.

A two-port isolator shown in, for example, FIG. 6 of Japanese Unexamined Patent Application Publication No. 2003-046307 is known as a non-reciprocal circuit element of the type described above. As shown in FIG. 6 of the above-cited document, in the two-port isolator, first and second center electrodes are disposed on a surface of a ferrite so that the first and second center electrodes intersect each other while being insulated from one another. A resistor is connected between one end of the first center electrode that is connected to an input port and one end of the second center electrode that is connected to an output port. An inductor is connected in series with the resistor.

This two-port isolator realizes an insertion loss bandwidth and an isolation bandwidth that are tolerable for practical use by setting the intersection angle between the first and second center electrodes to about 40 to 80 degrees. The inductor is arranged to compensate a phase shift resulting from a difference of the intersection angle from 90 degrees. However, in the two-port isolator, widening of the insertion loss bandwidth undesirably narrows the isolation bandwidth. Conversely, widening of the isolation bandwidth undesirably narrows the insertion loss bandwidth.

In addition, a two-port isolator shown in FIGS. 6 and 7 of International Publication No. WO2007/046229 is also known. In the two-port isolator, first and second center electrodes are arranged on a ferrite so that the first and second center electrodes intersect each other with being insulated from one another. One end of the first center electrode is connected to an input port, whereas the other end of the first center electrode and one end of the second center electrode are connected to an output port. The other end of the second center electrode is connected to a ground port. Furthermore, a matching capacitor and a resistor are connected in parallel between the input port and the output port.

This two-port isolator advantageously reduces an insertion loss significantly. However, widening of the isolation bandwidth is desired for this two-port isolator.

SUMMARY OF THE INVENTION

In order to overcome the problems described above, preferred embodiments of the present invention provide a non-reciprocal circuit element capable of improving an isolation characteristic without increasing an insertion loss.

To this end, a non-reciprocal circuit element according to a preferred embodiment of the present invention includes a permanent magnet, a ferrite arranged to receive a direct-current magnetic field from the permanent magnet, first and second center electrodes arranged on the ferrite so that the first and second center electrodes intersect each other while being insulated from one another, a first matching capacitor, a second matching capacitor, a resistor, and an inductor and a capacitor constituting an LC series resonant circuit. The one end of the first center electrode is electrically connected to an input port, whereas the other end of the first center electrode is electrically connected to an output port. One end of the second center electrode is electrically connected to the output port, whereas the other end of the second center electrode is electrically connected to a ground port. The first matching capacitor is electrically connected between the input port and the output port. The second matching capacitor is electrically connected between the output port and the ground port. The resistor is electrically connected between the input port and the output port. The inductor and the capacitor are electrically connected in parallel to the first center electrode and in series with the resistor between the input port and the output port.

In the non-reciprocal circuit element according to preferred embodiments of the present invention, the inductor and the capacitor constituting an LC series resonant circuit are electrically connected between the input port and the output port so as to be in parallel to the first center electrode and in series with the resistor. Thus, upon the output port being supplied with a high-frequency current, the impedance characteristic of the resistor and the LC series resonant circuit widens the isolation bandwidth, thereby improving the isolation characteristic. On the other hand, when the high-frequency current flows from the input port to the output port, a large amount of the high-frequency current flows through the second center electrode, whereas the high-frequency current hardly flows the first center electrode and the resistor. Accordingly, the loss due to the addition of the LC series resonant circuit can be ignored, and thus the insertion loss does not increase.

According to preferred embodiments of the present invention, since an inductor and a capacitor constituting an LC series resonant circuit are electrically connected between an input port and an output port so as to be in parallel to a first center electrode and in series with a resistor, an isolation characteristic can be improved while maintaining an insertion loss characteristic.

Other features, elements, characteristics, and advantages of the present invention will become more apparent from the following detailed description of preferred embodiments of the present invention with reference to the attached drawings.

DETAILED DESCRIPTION OF PREFERRED EMBODIMENTS

Non-reciprocal circuit elements according to preferred embodiments of the present invention will be described below with reference to the attached drawings.

First Preferred Embodiment

FIGS. 1 to 8B

Figure 1:
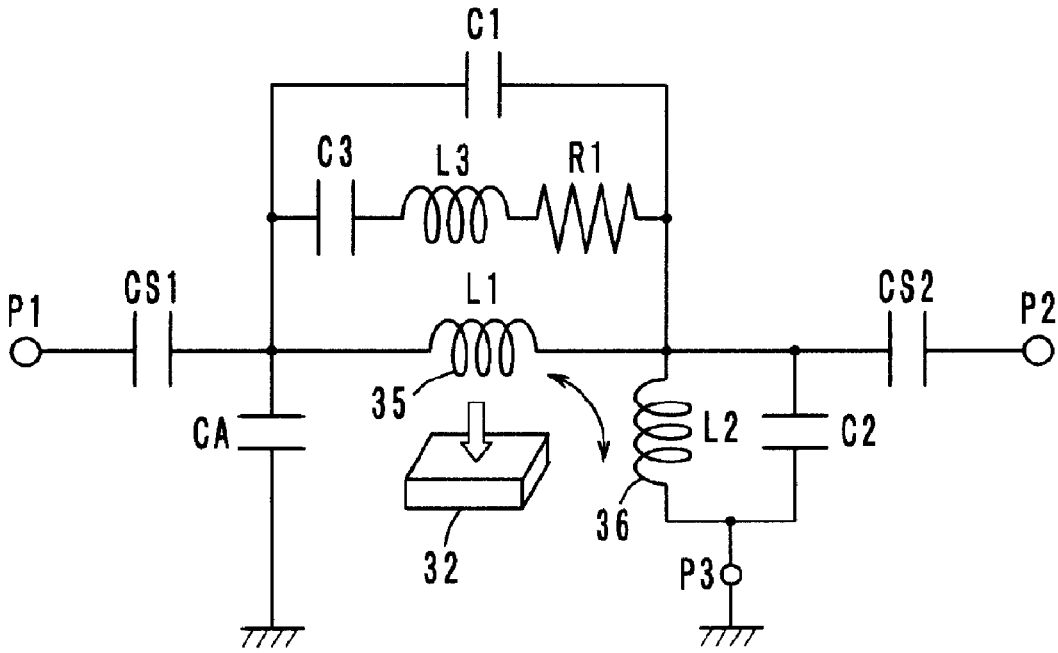
FIG. 1 is a diagram showing an equivalent circuit of a non-reciprocal circuit element (i.e., a two-port isolator) according to a first preferred embodiment of the present invention.

FIG. 1 shows an equivalent circuit of a two-port isolator serving as a non-reciprocal circuit element according to a first preferred embodiment of the present invention. This two-port isolator is preferably a lumped-constant isolator. In the two-port isolator, a first center electrode 35 constituting an inductor L1 and a second center electrode 36 constituting an inductor L2 are arranged on a ferrite 32 so that the electrodes 35 and 36 intersect each other while being insulated from one another.

One end of the first center electrode 35 is connected to an input port P1 through a matching capacitor CS1. The other end of the first center electrode 35 and one end of the second center electrode 36 are connected to an output port P2 through a matching capacitor CS2. The other end of the second center electrode 36 is connected to a ground port P3.

A matching capacitor C1 is connected in parallel to the first center electrode 35 between the input port P1 and the output port P2. A matching capacitor C2 is connected in parallel to the second center electrode 36 between the output port P2 and the ground port P3. A resistor R1 and an LC series resonant circuit (constituted by an inductor L3 and a capacitor C3) are connected in parallel to the first center electrode 35 between the input port P1 and the output port P2. Furthermore, an impedance-adjusting capacitor CA, which is connected to the ground, is connected to one end of the first center electrode 35.

In the two-port isolator having the above-described circuit configurations, upon the input port P1 being supplied with a high-frequency current, a large amount of the high-frequency current flows through the second center electrode 36 and the high-frequency current hardly flows through the first center electrode 35. Thus, an insertion loss becomes small and the two-port isolator works over a wide bandwidth. During this operation, the high-frequency current hardly flows the resistor R1 and the LC series resonant circuit (i.e., the inductor L3 and the capacitor C3). Thus, an insertion loss resulting from insertion of the LC series resonant circuit can be ignored, and the insertion loss does not increase.

On the other hand, upon the output port P2 being supplied with a high-frequency current, impedance characteristics of the resistor R1 and the LC series resonant circuit widens an isolation bandwidth, thereby improving an isolation characteristic. Such isolation and insertion loss characteristics will be described later with reference to FIGS. 7A, 7B, 8A and 8B.

Figure 2:
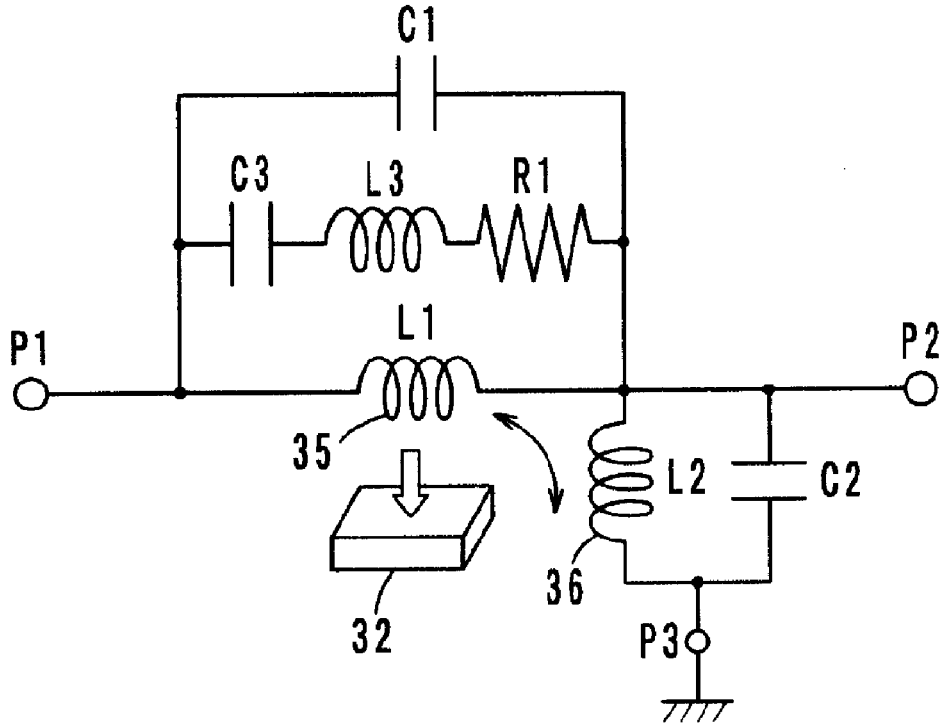
FIG. 2 is a diagram showing another equivalent circuit of a non-reciprocal circuit element according to a first preferred embodiment of the present invention.
Figure 3:
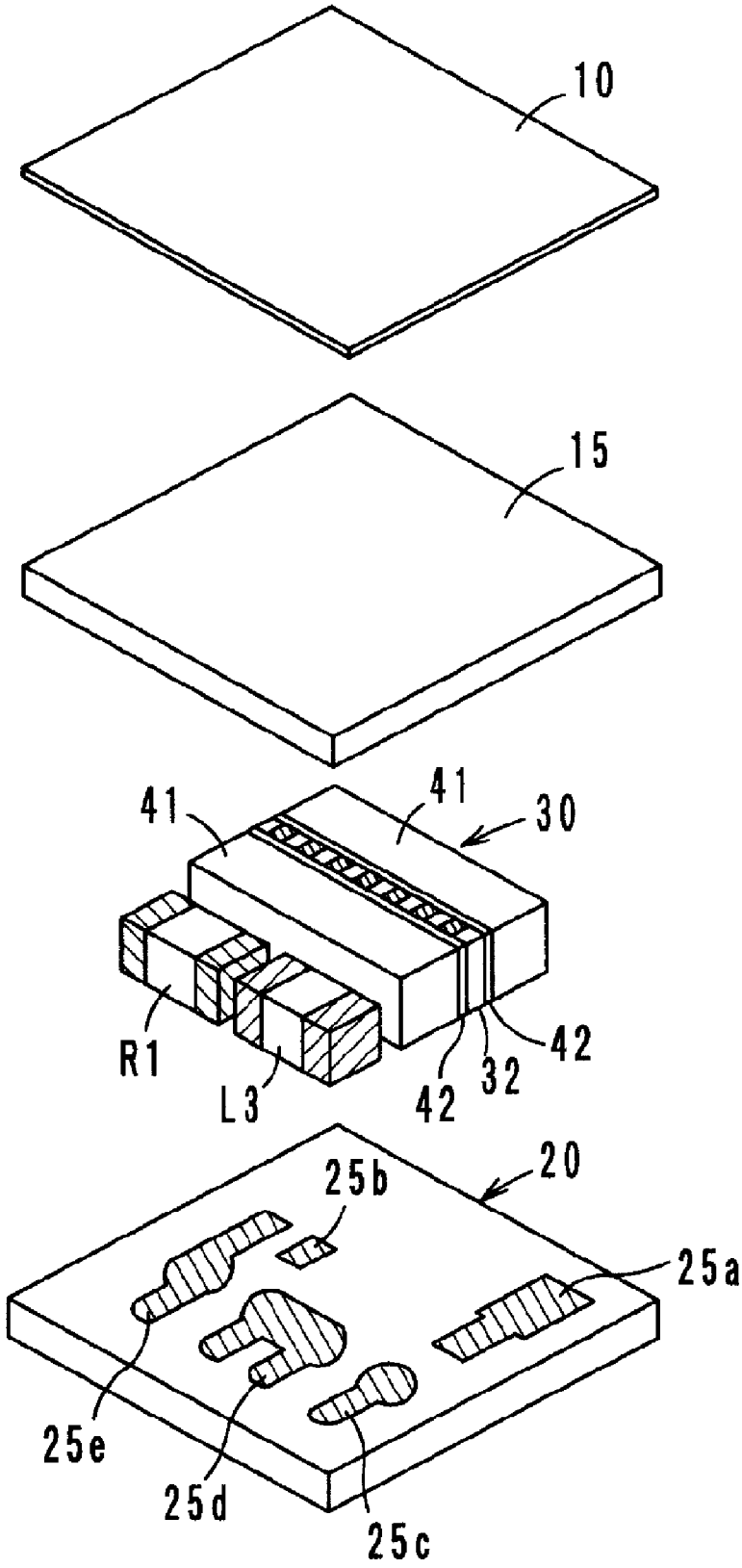
FIG. 3 is an exploded perspective view of a non-reciprocal circuit element according to a first preferred embodiment of the present invention.

The two-port isolator shown in FIG. 1 can be also configured as an equivalent circuit shown in FIG. 2. In a two-port isolator shown in FIG. 2, the capacitors CS1, CS2, and CA are omitted from the equivalent circuit shown in FIG. 1. The two-port isolator shown in FIG. 2 generally performs operations similar to those of the two-port isolator shown in FIG. 1.

A specific configuration of the two-port isolator shown in FIGS. 1 and 2 will be described next with reference to FIGS. 3 to 6. This lumped-constant two-port isolator includes a substantially planar yoke 10, a sealing resin 15, a circuit substrate 20, and a ferrite-magnet assembly 30 constituted by the ferrite 32 and permanent magnets 41. The resistor R1 and the inductor L3 are externally mounted on the circuit substrate 20. The other capacitors C1, C2, CS1, CS2, and CA are included in the multilayer circuit substrate 20. Shaded portions represent conductors in FIG. 3.

Figure 4:
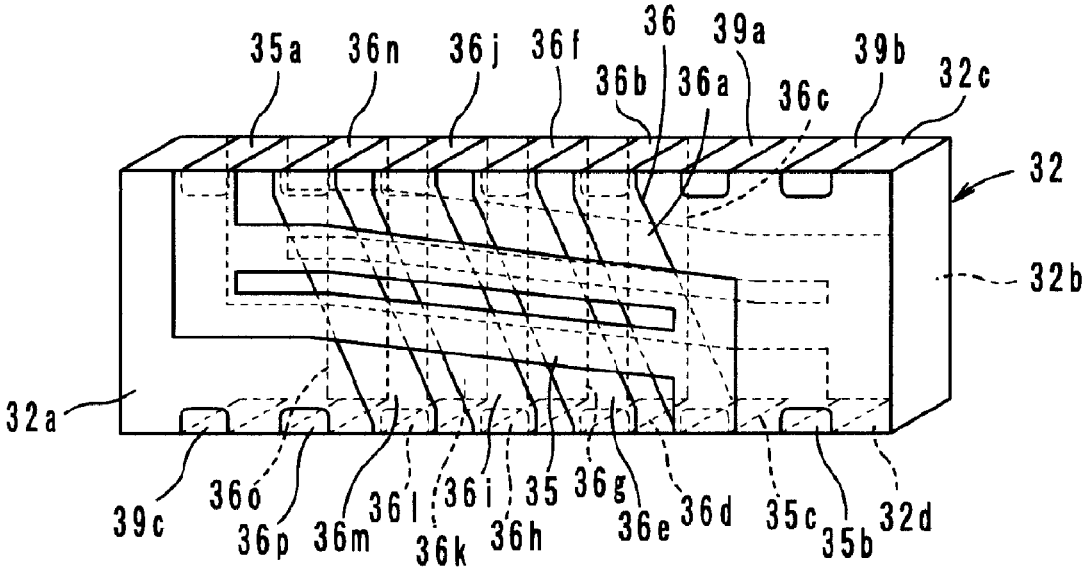
FIG. 4 is a perspective view of a ferrite including center electrodes.
Figure 5:
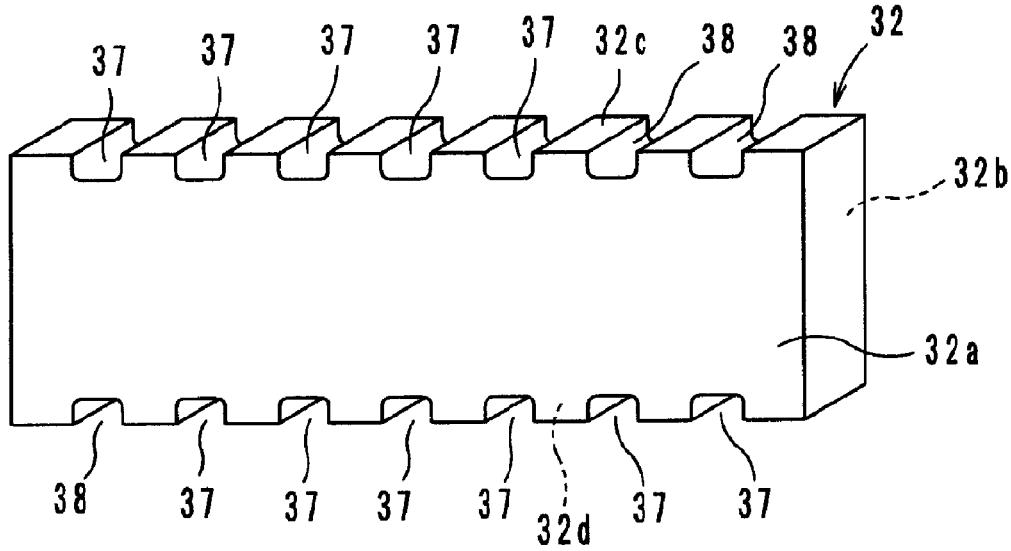
FIG. 5 is a perspective view of a ferrite.
Figure 6:
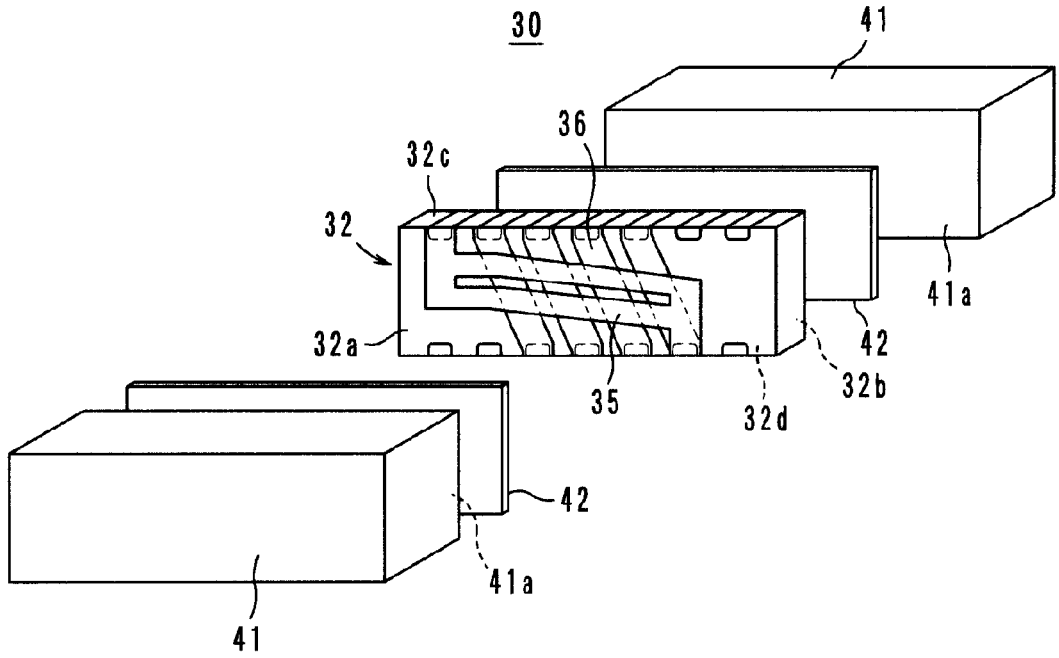
FIG. 6 is an exploded perspective view of a ferrite-magnet assembly.

As shown in FIG. 4, the first center electrode 35 and the second center electrode 36, which are electrically insulated from one another, are formed on back and front principal surfaces 32*a* and 32*b* of the ferrite 32. The ferrite 32 preferably has a substantially rectangular parallelepiped shape having the first principal surface 32*a* and the second principal surface 32*b*, which face each other and are substantially parallel with each other.

The permanent magnets 41 are adhered to the principal surfaces 32*a* and 32*b* with, for example, epoxy adhesives 42 (see FIG. 6) so that a direct-current magnetic field is applied to the principal surfaces 32*a* and 32*b* in the substantially vertical direction. In such a manner, the ferrite-magnet assembly 30 is formed. Principal surfaces 41*a* of the permanent magnets 41 preferably are substantially the same size as the principal surfaces 32*a* and 32*b* of the ferrite 32. The principal surfaces 32*a* and 32*b* and the principal surfaces 41*a* are arranged to face each other, respectively, so that the contours substantially match.

The first center electrode 35 is formed by a conductive film. More specifically, as shown in FIG. 4, the first center electrode 35 extends upward from a lower right section of the first principal surface 32*a* of the ferrite 32 and is bifurcated into two segments. The two segments extend in an upper left direction at a relatively small angle with respect to the longitudinal direction. The first center electrode 35 then extends upward to an upper left section and turns toward the second principal surface 32*b* through an intermediate electrode 35*a* on an upper surface 32*c*. On the second principal surface 32*b*, the first center electrode 35 is bifurcated into two segments again so as to overlap with that on the first principal surface 32*a* in the perspective view. One end of the first center electrode 35 is connected to a connector electrode 35*b* formed on a lower surface 32*d*. The other end of the first center electrode 35 is connected to a connector electrode 35*c* provided on the lower surface 32*d*. The first center electrode 35 is thus wound around the ferrite 32 by one turn. The first center electrode 35 and the second center electrode 36, which will be described below, have an insulating film therebetween, such that these electrodes intersect each other while being insulated from one another.

The second center electrode 36 is also formed by a conductive film. The second center electrode 36 has a 0.5th-turn segment 36*a* that extends in the upper left direction from a lower right section of the first principal surface 32*a* at a relatively large angle with respect to the longitudinal direction and intersects the first center electrode 35. The 0.5th-turn segment 36*a* makes a turn towards the second principal surface 32*b* through an intermediate electrode 36*b* on the upper surface 32*c* so as to connect to a 1st-turn segment 36*c*. On the second principal surface 32*b*, the 1st-turn segment 36*c* intersects the first center electrode 35 in a substantially perpendicular fashion. A lower end portion of the 1st-turn segment 36*c* makes a turn towards the first principal surface 32*a* through an intermediate electrode 36*d* on the lower surface 32*d* so as to connect to a 1.5th-turn segment 36*e*. On the first principal surface 32*a*, the 1.5th-turn segment 36*e* extends substantially parallel to the 0.5th-turn segment 36*a* and intersects the first center electrode 35. The 1.5th-turn segment 36*e* turns toward the second principal surface 32*b* through an intermediate electrode 36*f* on the upper surface 32*c*. In a similar manner, a 2nd-turn segment 36*g*, an intermediate electrode 36*h*, a 2.5th-turn segment 36*i*, an intermediate electrode 36*j*, a 3rd-turn segment 36*k*, an intermediate electrode 36*l*, a 3.5th-turn segment 36*m*, an intermediate electrode 36*n*, and a 4th-turn segment 36*o* are formed on the corresponding surfaces of the ferrite 32. The opposite ends of the second center electrode 36 are respectively connected to connector electrodes 35*c* and 36*p* provided on the lower surface 32*d* of the ferrite 32. The connector electrode 35*c* is commonly used among the ends of the first center electrode 35 and the second center electrode 36.

That is, the second center electrode 36 is helically wound around the ferrite 32 by four turns. The number of turns is calculated based on the fact that one crossing of the center electrode 36 across the first principal surface 32*a* or the second principal surface 32*b* equals a 0.5 turn. The intersection angle between the center electrodes 35 and 36 is set so as to adjust the input impedance and the insertion loss.

The connector electrodes 35*b*, 35*c*, and 36*p* and the intermediate electrodes 35*a*, 36*b*, 36*d*, 36*f*, 36*h*, 36*j*, 36*l*, and 36*n* are formed by embedding electrode conductors, such as silver, silver alloy, copper, and copper alloy, into corresponding recesses 37 (see FIG. 5) provided on the upper and lower surfaces 32*c* and 32*d* of the ferrite 32. In addition, the upper and lower surfaces 32*c* and 32*d* have dummy recesses 38 provided substantially in parallel to the electrodes, and are also provided with dummy electrodes 39*a*, 39*b*, and 39*c*. These electrodes are formed by preliminarily forming through holes in a mother ferrite substrate, embedding electrode conductors into these through holes, and then cutting the substrate along where the through holes are to be cut. These various electrodes may alternatively be formed as a conducting film in the recesses 37 and 38.

As the ferrite 32, a YIG ferrite may be used. Alternatively, other suitable ferrite materials may be used for the ferrite 32. The first and second center electrodes 35 and 36 and the other various electrodes are formed as a thick film or a thin film composed of silver or silver alloy by, for example, printing, transferring, or photolithography. The insulating film between the center electrodes 35 and 36 may be defined by a thick glass or alumina dielectric film or polyimide resin film. These insulating films can be also formed by, for example, printing, transferring, or photolithography.

The ferrite 32 including the insulating film and various electrodes can be collectively constituted by a magnetic substance and can be baked. In such a case, Pd or Pd/Ag that are tolerant of baking at a high temperature are used as the various electrodes.

Strontium, barium, or lanthanum-cobalt ferrite magnets are generally used as the permanent magnets 41. Preferably, a one-part thermosetting epoxy adhesive is used as the adhesive 42 that adheres the permanent magnets 41 and the ferrite 32.

The circuit substrate 20 preferably is a sintered multilayer substrate having predetermined electrodes provided on a plurality of dielectric sheets. The circuit substrate 20 includes matching capacitors C1, C2, CS1, CS2, and CA shown in the equivalent circuits of FIGS. 1 and 2. The terminal resistance R1 and the inductor L3 are externally mounted on the circuit substrate 20. The circuit substrate 20 also includes terminal electrodes 25*a* to 25*e* on the top surface thereof and external-connection terminal electrodes (not shown) on the bottom surface thereof. The detailed description about the multilayer structure of the circuit substrate 20 is omitted herein.

The ferrite-magnet assembly 30 is mounted on the circuit substrate 20. Various electrodes on the lower surface 32*d* of the ferrite 32, the resistor R1, and the inductor L3 are combined with the terminal electrodes 25*a* to 25*e* disposed on the circuit substrate 20 by reflow soldering. Additionally, the lower surfaces of the permanent magnets 41 are bonded on the circuit substrate 20 with an adhesive. Here, the connector electrodes 36*p*, 35*c*, and 35*b* are connected to the terminal electrodes 25*a*, 25*b*, and 25*e*, respectively.

The planar yoke 10 has an electromagnetic shielding function. The yoke 10 is fixed on the ferrite-magnet assembly 30 through the sealing resin 15. The planar yoke 10 has functions of suppressing a magnetic leakage and a high-frequency electromagnetic field leakage from the ferrite-magnet assembly 30, of suppressing magnetic effects from the external environment, and of providing a portion to be taken up by a vacuum nozzle when this isolator is mounted on a substrate, not shown, using a chip mounter. The planar yoke 10 does not have to be grounded, but may be grounded by soldering or a conductive adhesive. Ground connection of the yoke 10 improves the effect of the high-frequency shielding.

Figure 7A:
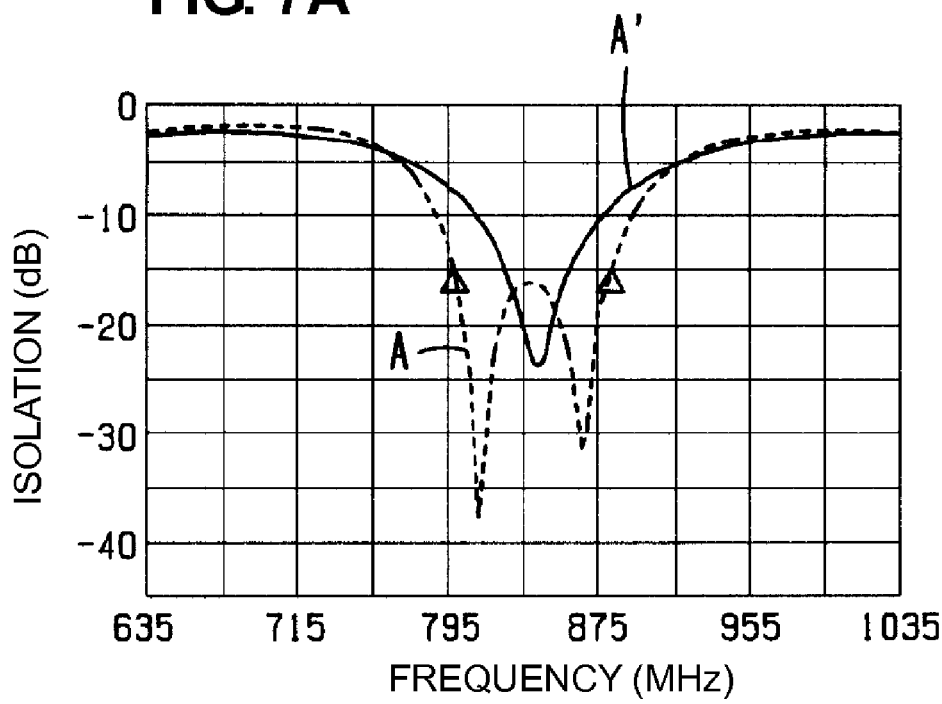
FIGS. 7A and 7B are graphs showing an isolation characteristic and an insertion loss characteristic of a first exemplary isolator, respectively.
Figure 7B:
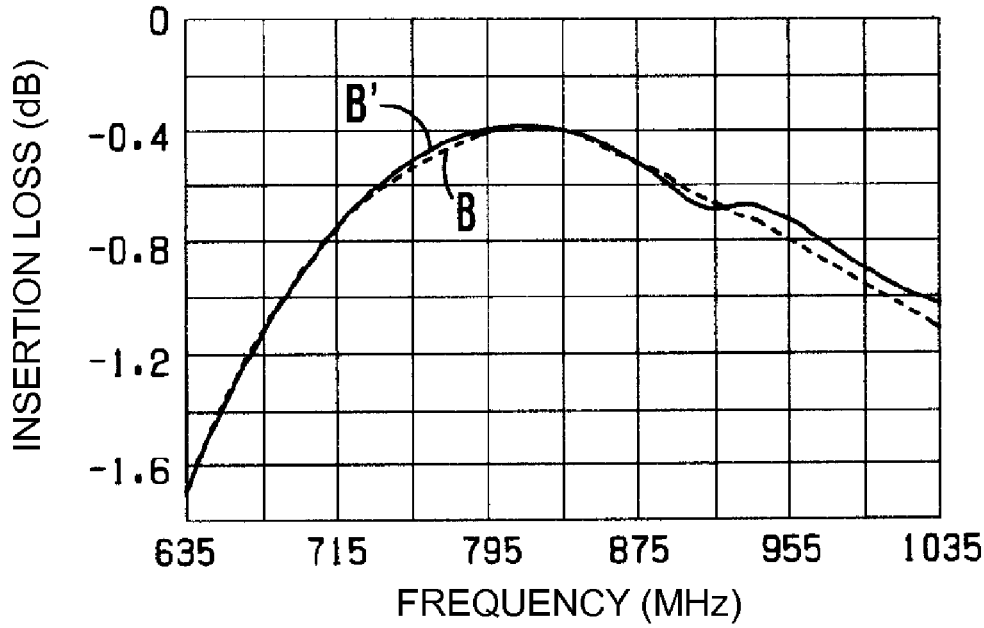

Now, an isolation characteristic and an insertion loss characteristic of the two-port isolator will be described with reference to FIGS. 7A, 7B, 8A and 8B. The characteristics shown in FIGS. 7A and 7B are based on data obtained by measurement in a first exemplary isolator having configurations of an equivalent circuit shown in FIG. 1 and in FIGS. 3 to 6, and having the following specifications:

Capacitor C1: about 17.0 pF
Capacitor C3: about 0.40 pF
Inductor L3: about 80.0 nH
Resistor R1: about 30.0Ω
Capacitor C2: about 1.50 pF
Capacitor CA: about 0.40 pF
Capacitor CS1: about 7.0 pF
Capacitor CS2: about 7.0 pF FIG. 7A shows an isolation characteristic. A dotted curved line A shows data obtained in the first exemplary isolator. On the other hand, a solid curved line A' shows data obtained in a comparative exemplary isolator having the same specifications excluding the series resonant circuit (i.e., the inductor L3 and the capacitor C3). A frequency range corresponding to the isolation level of approximately −15 dB is widened to a range of approximately 797.9 to 880.4 MHz (i.e., approximately 82.5 MHz in the bandwidth). In addition, FIG. 7B shows an insertion loss characteristic. A dotted curved line B shows data obtained in the first exemplary isolator, while a solid curved line B' shows data obtained in the comparative exemplary isolator. The first exemplary isolator maintains the insertion loss characteristic similar to the comparative exemplary isolator.

Figure 8A:
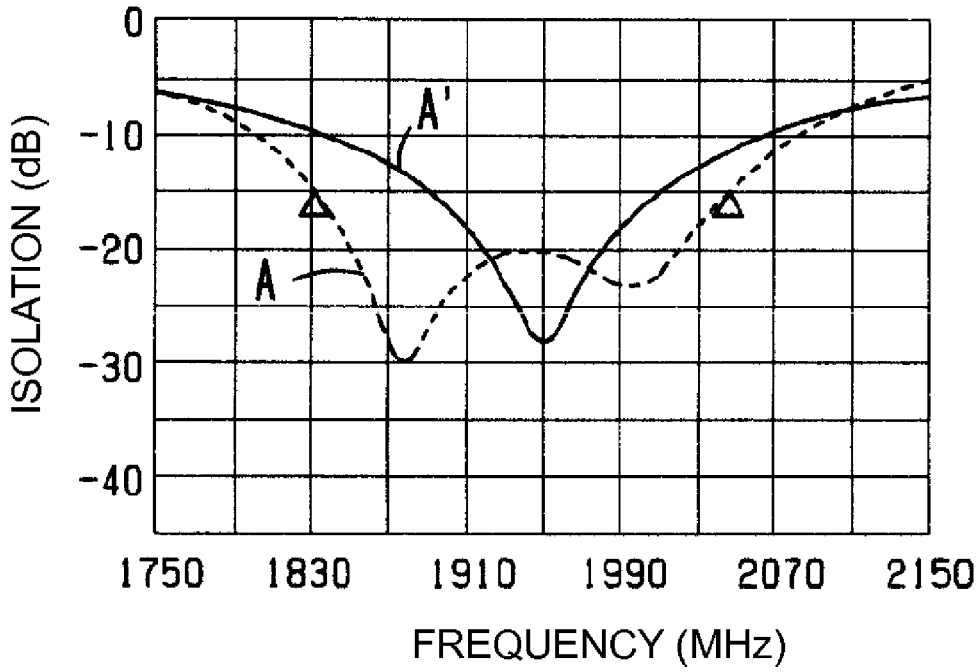
FIGS. 8A and 8B are graphs showing an isolation characteristic and an insertion loss characteristic of a second exemplary isolator, respectively.
Figure 8B:
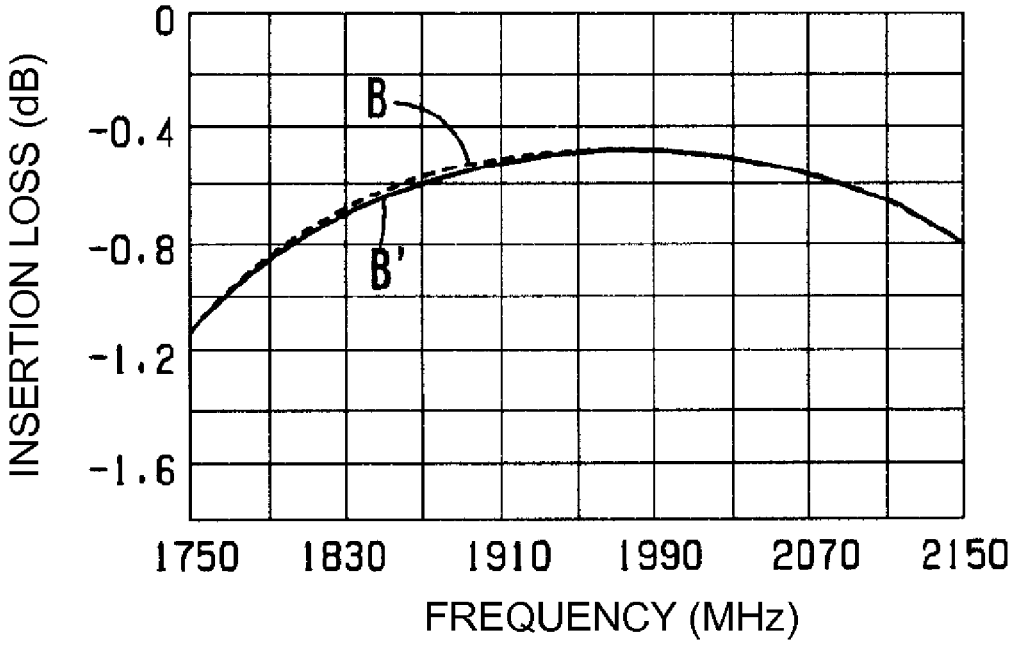

The characteristics shown in FIGS. 8A and 8B are based on data obtained by measurement in a second exemplary isolator having configurations of an equivalent circuit shown in FIG. 1 and in FIGS. 3 to 6, and having the following specifications:

Capacitor C1: about 5.0 pF
Capacitor C3: about 0.10 pF
Inductor L3: about 60.0 nH
Resistor R1: about 35.0Ω
Capacitor C2: about 0.60 pF
Capacitor CA: about 0.10 pF Capacitor CS1: about 2.0 pF
Capacitor CS2: about 2.0 pF FIG. 8A shows an isolation characteristic. A dotted curved line A shows data obtained in the second exemplary isolator, while a solid curved line A' shows data obtained in a comparative exemplary isolator having the same specifications excluding the series resonant circuit (i.e., the inductor L3 and the capacitor C3). A frequency range corresponding to the isolation level of approximately −15 dB is widened to a range of approximately 1833.0 to 2044.7 MHz (i.e., approximately 211.7 MHz in the bandwidth). In addition, FIG. 8B shows an insertion loss characteristic. A dotted curved line B shows data obtained in the second exemplary isolator, while a solid curved line B' shows data obtained in the comparative exemplary isolator. The second exemplary isolator maintains the insertion loss characteristic similar to the comparative exemplary isolator.

Furthermore, according to the first preferred embodiment, since the ferrite 32 and one pair of permanent magnets 41 are bonded with the adhesives 42, the ferrite-magnet assembly 30 becomes structurally stable. Thus, a solid isolator that is not deformed nor damaged by vibration or shock can be obtained.

In addition, the circuit substrate 20 is preferably constituted of a multilayer dielectric substrate. Such a configuration allows a network of capacitors and resistors to be included the circuit substrate 20, thereby achieving miniaturization and thinning of an isolator. Additionally, since connections of circuit elements are included in the substrate, the reliability is expected to improve.

Second Preferred Embodiment

Figure 9:
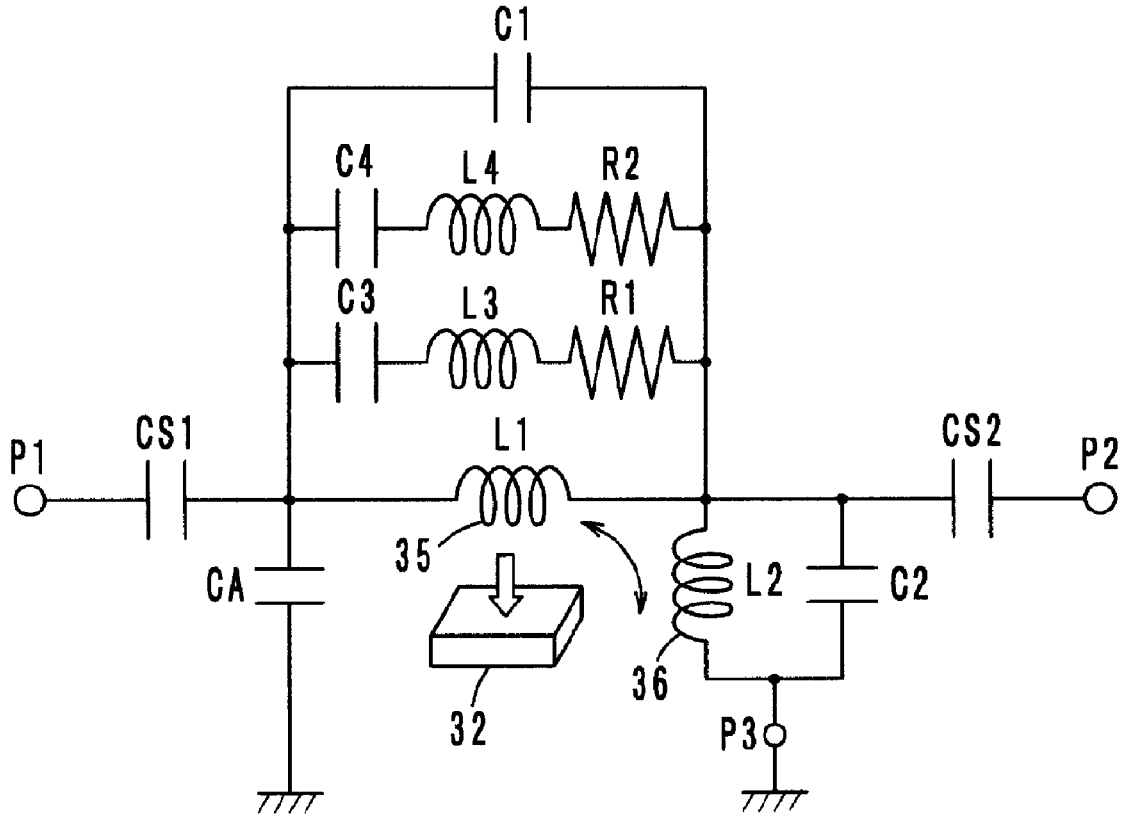
FIG. 9 is a diagram showing an equivalent circuit of a non-reciprocal circuit element (i.e., a two-port isolator) according to a second preferred embodiment of the present invention.
Figure 10A:
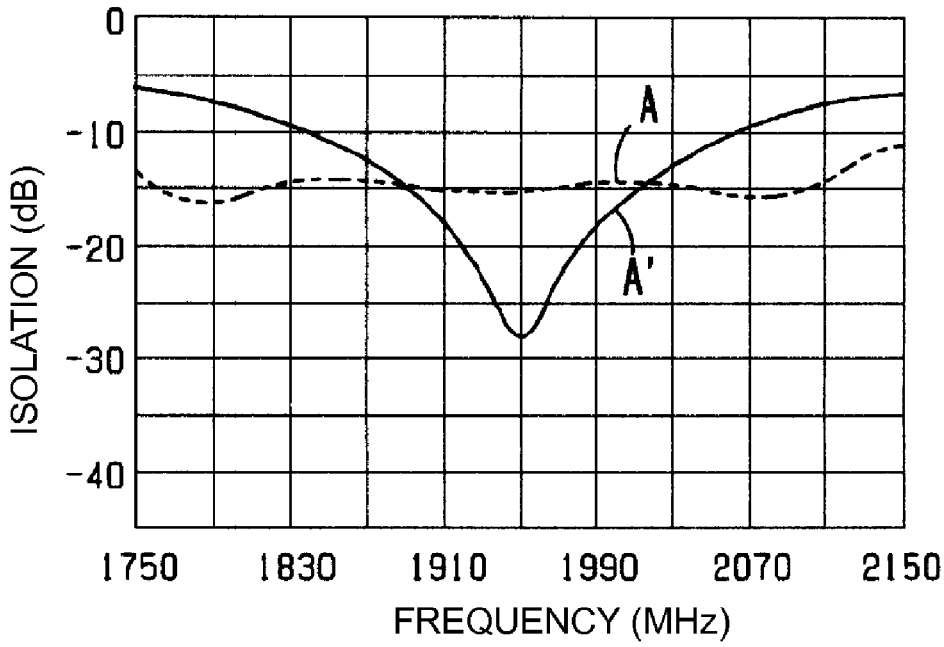
FIGS. 10A and 10B are graphs showing an isolation characteristic and an insertion loss characteristic of a non-reciprocal circuit element according to a second preferred embodiment of the present invention, respectively.
Figure 10B:
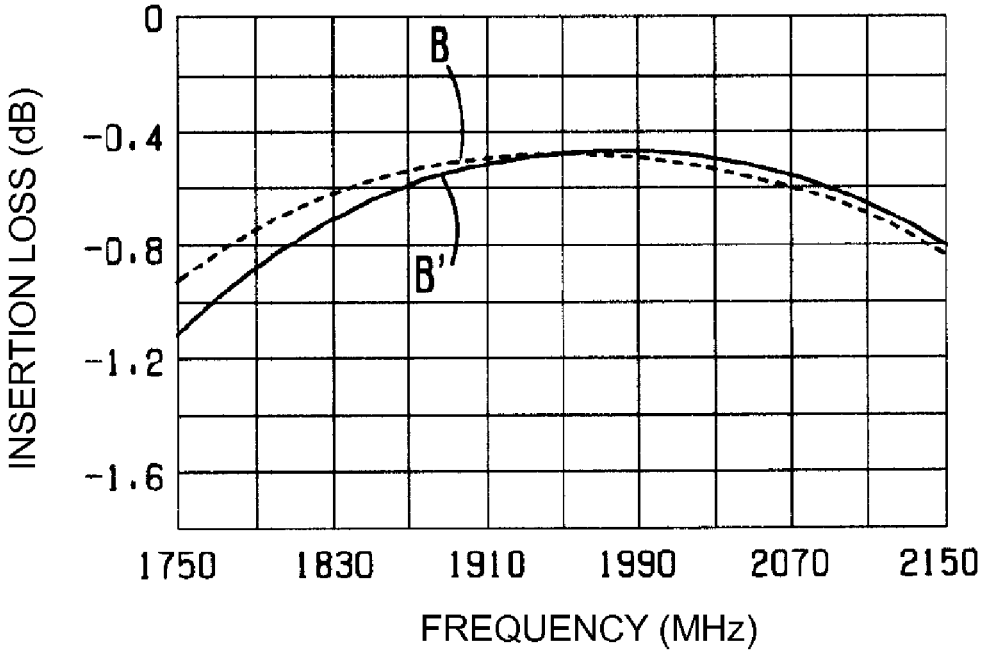

FIGS. 9, 10A, and 10B

FIG. 9 shows an equivalent circuit of a two-port isolator serving as a non-reciprocal circuit element according to a second preferred embodiment of the present invention. This two-port isolator basically has configurations of the equivalent circuit shown in FIG. 1 and in FIGS. 3 to 6, and additionally includes a resistor R2 and a series resonant circuit (constituted by an inductor L4 and a capacitor C4) that are connected in parallel to a first center electrode 35.

Now, an isolation characteristic and an insertion loss characteristic of the two-port isolator according to the second preferred embodiment will be described with reference to FIGS. 10A and 10B. The characteristics shown in FIGS. 10A and 10B are based on data obtained by measurement in a two-port isolator having configurations of the equivalent circuit shown in FIG. 9 and in FIGS. 3 to 6, and having the following specifications:

Capacitor C1: about 5.0 pF
Capacitor C3: about 0.10 pF
Inductor L3: about 60.0 nH
Resistor R1: about 40.0Ω
Capacitor C4: about 0.10 pF
Inductor L4: about 60.0 nH
Resistor R2: about 40.0Ω
Capacitor C2: about 0.60 pF
Capacitor CA: about 0.10 pF
Capacitor CS1: about 2.0 pF
Capacitor CS2: about 2.0 pF FIG. 10A shows an isolation characteristic. A dotted curved line A shows data obtained in the isolator according to the second preferred embodiment. On the other hand, a solid curved line A' shows data obtained in a comparative exemplary isolator having the same specifications excluding the series resonant circuits (i.e., the inductors L3 and L4 and the capacitors C3 and C4). FIG. 10A shows that the isolation bandwidth is greatly widened. In addition, FIG. 10B shows an insertion loss characteristic. A dotted curved line B shows data obtained in the isolator according to the second preferred embodiment, while a solid curved line B' shows data obtained in the comparative exemplary isolator. The isolator according to the second preferred embodiment maintains the insertion loss characteristic similar to the comparative exemplary isolator.

Other Preferred Embodiments

Configurations of a non-reciprocal circuit element are not limited to the above-described preferred embodiments of the present invention, and various modifications are permissible within the scope and spirit of the present invention.

For example, by inverting the N-pole and the S-pole of the permanent magnets 41, the input port P1 and the output port P2 can be switched. Additionally, shapes of the first and second center electrodes 35 and 36 can be modified in various manners. For example, although the first center electrode 35 bifurcated into two segments on the principal surface 32*a* and 32*b* of the ferrite 32 is shown in the first preferred embodiment, the first center electrode 35 does not have to be bifurcated. In addition, the second center electrode 35 may be wound by at least one turn.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A non-reciprocal circuit element comprising:

a permanent magnet;

a ferrite arranged to receive a direct-current magnetic field from the permanent magnet;

a first center electrode disposed on the ferrite, one end of the first center electrode being electrically connected to an input port, and the other end of the first center electrode being electrically connected to an output port;

a second center electrode arranged on the ferrite so as to intersect the first center electrode with being insulated from the first center electrode, one end of the second center electrode being electrically connected to the output port, and the other end of the second center electrode being electrically connected to a ground port;

a first matching capacitor electrically connected between the input port and the output port;

a second matching capacitor electrically connected between the output port and the ground port;

a resistor electrically connected between the input port and the output port; and an inductor and a capacitor constituting an LC series resonant circuit electrically connected in parallel to the first center electrode and in series with the resistor between the input port and the output port.

2. The non-reciprocal circuit element according to claim 1, wherein a plurality of series circuits, each constituted by the resistor, the inductor, and the capacitor, are electrically connected in parallel to the first center electrode.

3. The non-reciprocal circuit element according to claim 1, further comprising a third matching capacitor electrically connected between the input port and one end of the first center electrode, and a fourth matching capacitor electrically connected between the output port and the other end of the first center electrode.

4. The non-reciprocal circuit element according to claim 1, wherein the first and second center electrodes are constituted by conductive films disposed on first and second facing principal surfaces of the ferrite so as to intersect each other with being electrically insulated from one another.

5. The non-reciprocal circuit element according to claim 4, wherein the ferrite is sandwiched by a pair of the permanent magnets in parallel to the first and second principal surfaces, on which the first and second center electrodes are disposed, so as to constitute a ferrite-magnet assembly.

6. The non-reciprocal circuit element according to claim 5, further comprising a circuit substrate having a terminal electrode disposed on a surface thereof, wherein the ferrite-magnet assembly is mounted on the circuit substrate so that first and second principal surfaces of the ferrite-magnet assembly are vertical to a surface of the circuit substrate.

* * * * *